US010370949B2

(12) United States Patent
Filatyev et al.

(10) Patent No.: US 10,370,949 B2
(45) Date of Patent: Aug. 6, 2019

(54) THERMAL CONDITIONING OF FISHBONE WELL CONFIGURATIONS

(71) Applicant: CONOCOPHILLIPS COMPANY, Houston, TX (US)

(72) Inventors: Sergei A. Filatyev, Houston, TX (US); Pradeep Ananth Govind, Calgary (CA); Thomas J. Wheeler, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 15/274,235

(22) Filed: Sep. 23, 2016

(65) Prior Publication Data

US 2017/0081950 A1 Mar. 23, 2017

Related U.S. Application Data

(60) Provisional application No. 62/222,543, filed on Sep. 23, 2015.

(51) Int. Cl.

| | |
|---|---|
| ***E21B 43/24*** | (2006.01) |
| ***E21B 36/00*** | (2006.01) |
| ***E21B 36/04*** | (2006.01) |
| ***E21B 43/17*** | (2006.01) |
| ***E21B 43/30*** | (2006.01) |

(52) U.S. Cl.

CPC ..... *E21B 43/2408* (2013.01); *E21B 36/008* (2013.01); *E21B 36/04* (2013.01); *E21B 43/17* (2013.01); *E21B 43/2401* (2013.01); *E21B 43/305* (2013.01)

(58) Field of Classification Search

CPC .... E21B 43/24; E21B 43/2408; E21B 36/008; E21B 36/04; E21B 43/17

See application file for complete search history.

(56) References Cited

U.S. PATENT DOCUMENTS

| | | | |
|---|---|---|---|
| 2,548,360 | A | 4/1951 | Germain |
| 2,634,961 | A | 4/1953 | Ljungstrom |
| 2,732,195 | A | 1/1956 | Ljungstrom |
| 2,780,450 | A | 2/1957 | Ljungstrom |
| 3,642,066 | A | 2/1972 | Gill |
| 4,716,960 | A | 1/1988 | Eastlund |

(Continued)

FOREIGN PATENT DOCUMENTS

| | | |
|---|---|---|
| CA | 2684049 | 7/2014 |
| WO | 2013130361 | 9/2013 |

OTHER PUBLICATIONS

EME 580 Final Report: Husain et al., Economic Comparison of Multi-Lateral Drilling over Horizontal Drilling for Marcellus Shale Field (2011).

(Continued)

*Primary Examiner* — Zakiya W Bates
*Assistant Examiner* — Crystal J Miller
(74) *Attorney, Agent, or Firm* — ConocoPhillips Company

(57) ABSTRACT

The present disclosure relates to a particularly effective well configuration that can be used for SAGD and other steam based oil recovery methods. Fishbone multilateral wells are combined with SAGD, effectively expanding steam coverage, but the fishbones are preheated to mitigate plugging problems, with e.g., resistive heating, EM heating or chemical heating.

16 Claims, 4 Drawing Sheets

(56) References Cited

U.S. PATENT DOCUMENTS 4,892,782 A 1/1990 Fisher
5,060,287 A 10/1991 Van Egmond
5,082,054 A 1/1992 Kiamanesh
5,109,927 A * 5/1992 Supernaw ..... E21B 43/2401 166/248
5,273,111 A * 12/1993 Brannan ..... E21B 43/2406 166/245
5,378,879 A 1/1995 Monovoukas
5,621,844 A 4/1997 Bridges
6,023,554 A 2/2000 Vinegar et al.
6,045,648 A 4/2000 Palmgren et al.
6,257,334 B1 * 7/2001 Cyr ..... E21B 43/2406 166/263
6,285,014 B1 9/2001 Beck et al.
6,348,679 B1 2/2002 Ryan et al.
6,353,706 B1 3/2002 Bridges
6,360,819 B1 3/2002 Vinegar
6,649,888 B2 11/2003 Ryan et al.
6,942,032 B2 9/2005 La Rovere
7,066,254 B2 * 6/2006 Vinegar ..... E21B 36/04 166/245
7,165,607 B2 1/2007 La Rovere
8,087,460 B2 1/2012 Kaminsky
8,118,095 B2 * 2/2012 Sarathi ..... E21B 43/243 166/256
8,128,786 B2 3/2012 White
8,133,384 B2 3/2012 Parsche
8,168,570 B2 5/2012 Barron
8,307,915 B2 * 11/2012 Clark ..... E21B 41/0035 166/245
8,333,245 B2 12/2012 Zupanick
8,337,769 B2 12/2012 Parsche
8,376,052 B2 2/2013 Zupanick
8,381,810 B2 * 2/2013 Dreher, Jr. ..... E21B 43/243 166/245
8,555,970 B2 * 10/2013 Wheeler ..... E21B 43/2408 166/248
8,616,273 B2 12/2013 Trautman
8,646,527 B2 * 2/2014 Trautman ..... E21B 43/2401 166/272.1
8,674,274 B2 3/2014 Parsche
8,691,731 B2 4/2014 Jennings
8,695,730 B2 * 4/2014 Clark ..... E21B 41/0035 166/245
8,701,770 B2 * 4/2014 Schultz ..... E21B 36/02 166/272.7
8,729,440 B2 5/2014 Parsche
8,772,683 B2 7/2014 Parsche
8,783,347 B2 * 7/2014 Trautman ..... E21B 43/2401 166/272.1
8,807,220 B2 8/2014 Madison
8,936,090 B2 * 1/2015 Sultenfuss ..... E21B 43/2401 166/272.3
8,960,286 B2 2/2015 Banerjee
9,453,400 B2 * 9/2016 Wheeler ..... E21B 43/24
9,512,701 B2 * 12/2016 Duphorne ..... E21B 43/12
2003/0155111 A1 * 8/2003 Vinegar ..... E21B 36/04 166/59
2006/0081374 A1 4/2006 Bland
2007/0044957 A1 * 3/2007 Watson ..... E21B 33/03 166/245
2009/0255661 A1 * 10/2009 Clark ..... E21B 41/0035 166/50
2010/0206555 A1 * 8/2010 Menard ..... E21B 43/2406 166/245
2010/0206563 A1 * 8/2010 Sarathi ..... E21B 43/305 166/256
2010/0294488 A1 * 11/2010 Wheeler ..... E21B 43/2408 166/248
2011/0036576 A1 * 2/2011 Schultz ..... E21B 36/02 166/303
2011/0067858 A1 * 3/2011 Dreher ..... E21B 43/243 166/251.1
2012/0061080 A1 * 3/2012 Sultenfuss ..... E21B 43/2401 166/302
2012/0067572 A1 * 3/2012 Trautman ..... E21B 43/2401 166/272.3
2012/0085533 A1 4/2012 Madison
2012/0227966 A1 9/2012 Dreher, Jr.
2012/0234536 A1 * 9/2012 Wheeler ..... E21B 43/24 166/272.1
2012/0241150 A1 * 9/2012 Al Yahyai ..... E21B 43/14 166/270
2012/0247760 A1 * 10/2012 Wheeler ..... E21B 43/2406 166/272.3
2012/0305239 A1 12/2012 Sultenfuss
2013/0008651 A1 1/2013 Trautman et al.
2013/0075084 A1 * 3/2013 Clark ..... E21B 41/0035 166/245
2013/0118737 A1 * 5/2013 Schneider ..... E21B 43/2406 166/272.3
2013/0146285 A1 * 6/2013 Chhina ..... E21B 43/00 166/268
2013/0220616 A1 8/2013 Seth et al.
2014/0069638 A1 * 3/2014 Trautman ..... E21B 43/2401 166/248
2014/0090839 A1 4/2014 Al-Nakhli et al.
2014/0110395 A1 4/2014 Parsche
2014/0124194 A1 * 5/2014 Jorshari ..... E21B 43/2406 166/245
2014/0131044 A1 5/2014 Parsche
2014/0182850 A1 * 7/2014 Shahin ..... C09K 8/592 166/266
2014/0262242 A1 * 9/2014 Rees ..... E21B 43/2408 166/250.01
2014/0266951 A1 9/2014 Okoniewski et al.
2014/0345855 A1 11/2014 Wilfing et al.
2014/0345861 A1 11/2014 Stalder
2014/0367097 A1 * 12/2014 Milam ..... E21B 43/24 166/272.4
2015/0000912 A1 1/2015 Choudhary
2015/0013980 A1 * 1/2015 Duphorne ..... E21B 43/088 166/276
2015/0198022 A1 * 7/2015 Stanecki ..... E21B 43/24 166/272.3

OTHER PUBLICATIONS

Hogg C. (Jan. 1, 1997). Comparison of Multilateral Completion Scenarios and Their Application. Society of Petroleum Engineers. SPE-38493-MS.

Lougheide et al. Trinidad's First Multilateral Well Successfully Integrates Horizontal Openhole Gravel Packs, OTC (2004). OTC 16244.

Stadler, "Multilateral-Horizontal Wells Increase Rate and Lower Cost Per Barrel in the Zuata Field, Faja, Venezuela", Mar. 12, 2001. SPE 69700-MS.

Stalder J.L., et al., Alternative Well Configurations in SAGD: Rearranging Wells to Improve Performance, presented at 2012 World Heavy Oil Congress [WHOC12].

Hale, A., Sandberg, C., & Kovscek, A. (2013, Apr. 19). History and Application of Resistance Electrical Heating in Downhole Oil Field Applications. Society of Petroleum Engineers. doi:10.2118/165323-MS.

* cited by examiner

THERMAL CONDITIONING OF FISHBONE WELL CONFIGURATIONS

PRIORITY CLAIM

This application is a non-provisional application which claims benefit under 35 USC § 119(e) to U.S. Provisional Application Ser. No. 62/222,543 filed Sep. 23, 2015, entitled "THERMAL CONDITIONING OF FISHBONES," which is incorporated herein in its entirety.

FEDERALLY SPONSORED RESEARCH STATEMENT

Not Applicable

FIELD OF THE INVENTION

This invention relates generally to well configurations that can advantageously produce oil using steam-based mobilizing techniques, and their pretreatment to prevent bitumen plugging.

BACKGROUND OF THE INVENTION

Many countries in the world have large deposits of oil sands, including the United States, Russia, and the Middle East, but the world's largest deposits occur in Canada. Oil sands are a type of unconventional petroleum deposit. The sands contain naturally occurring mixtures of sand, clay, water, and a dense and extremely viscous form of petroleum technically referred to as "bitumen," but which may also be called heavy oil or tar. At room temperature, bitumen is much like cold molasses. Often times, the viscosity can be in excess of 1,000,000 cP.

Due to their high viscosity, these heavy oils are hard to mobilize, and they generally must be made to flow in order to produce and transport them. Methods for mobilizing heavy oil have been previously established, and include, but are not limited to, the addition of gases, solvents, and energy, individually or in combination. However, Steam Assisted Gravity Drainage or "SAGD" is the most extensively used technique for in situ recovery of bitumen resources in the McMurray Formation in the Alberta Oil Sands.

In a typical SAGD process, shown in FIG. 1, two horizontal wells are vertically spaced by 4 to 10 meters (m). The production well is located near the bottom of the pay and the steam injection well is located directly above and parallel to the production well. In SAGD, steam is injected continuously into the injection well, where it rises in the reservoir and forms a steam chamber.

With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity segregation within steam chamber.

This use of gravity gives SAGD an advantage over conventional steam injection methods. SAGD employs gravity as the driving force and the heated oil remains warm and movable when flowing toward the production well. In contrast, conventional steam injection displaces oil to a cold area, where its viscosity increases and the oil mobility is again reduced.

Conventional SAGD tends to develop a cylindrical steam chamber with a somewhat tear drop or inverted triangular cross section. With several SAGD well pairs operating side by side, the steam chambers tend to coalesce near the top of the pay, leaving the lower "wedge" shaped regions midway between the steam chambers to be drained more slowly, if at all. Operators may install additional producing wells in these midway regions to accelerate recovery, as shown in FIG. 2, and such wells are called "infill" wells, filling in the area where oil would normally be stranded between SAGD well-pairs (e.g., US20130008651).

Although quite successful, SAGD does require enormous amounts of water in order to generate a barrel of oil. Some estimates provide that 1 barrel of oil from the Athabasca oil sands requires on average 2 to 3 barrels of water (cold water equivalent) and as many as 7 barrels, although with recycling the total amount can be reduced to 0.5 barrel. In addition to using a precious resource, additional costs are added to convert those barrels of water to high quality steam for downhole injection. Therefore, any technology that can reduce water or steam consumption has the potential to have significant positive environmental and cost impacts.

One concept for improving production is the "multilateral" or "fishbone" well configuration idea. The concept of fishbone wells for non-thermal horizontal wells was developed by Petrozuata in Venezuela starting in 1999. That operation was a cold, viscous oil development in the Faja del Orinoco Heavy Oil Belt. The basic concept was to drill open-hole side lateral wells or "ribs" off the main spine of a producing well prior to running slotted liner into the spine of the well. Such ribs appeared to significantly contribute to the productivity of the wells when compared to wells without the ribs in similar geology.

The advantages of multilateral wells can include:

Higher Production. In the cases where thin pools are targeted, vertical wells yield small contact with the reservoir, limited to the reservoir thickness, which results in lower production. Drilling several laterals in thin reservoirs and increasing contact improves recovery. Slanted laterals can be of particular benefit in thin stacked pay zones.

Decreased Water/Gas Coning. By increasing the length of "wellbore" in a horizontal strata, the inflow flux around the wellbore can be reduced. This allows a higher withdrawal rate with less pressure gradient around the producer. Coning is aggravated by pressure gradients that exceed the gravity forces that stabilize fluid contacts (oil/water or gas/water), so that coning is minimized with the use of multilaterals, which minimize the pressure gradient.

Improved sweep efficiency. By using multilateral wells, the sweep efficiency may be improved, and/or the recovery may be increased due to the additional area covered by the laterals.

Faster Recovery. Production from the multilateral wells is at a higher rate than that in single vertical or horizontal wells, because the reservoir contact is higher in multilateral wells.

Decreased environmental impact. The volume of consumed drilling fluids and the generated cuttings during drilling multilateral wells are less than the consumed drilling fluid and generated cuttings from separated wells, at least to the extent that two conventional horizontal wells are replaced by one dual lateral well and to the extent that laterals share the same motherbore. Therefore, the impact of the multilateral wells on the environment can be reduced.

Saving time and cost. Drilling several laterals in a single well may result in time and cost saving in comparison with drilling several separate wells in the reservoir.

Although an improvement in some respects, the multilateral well methods have disadvantages too. One disadvantage is that fishbone wells are more complex to drill and clean up. Another disadvantage is increased risk of accident or damage, due to the complexity of the operations and tools. Sand control can also be difficult. In drilling multilateral wells, the mother well bore can be cased to control sand production, however, the legs branched from the mother well bore are open hole. Therefore, the sand control from the branches is not easy to perform. There is also increased difficulty in modeling and prediction due to the sophisticated architecture of multilateral wells.

One area of uncertainty with the fishbone concept is whether the ribs will establish and maintain communication with the offset steam chambers, or will the open-hole ribs collapse early and block flow. One of the characteristics of the Athabasca Oil Sands is that they are unconsolidated sands that are bound by the million-plus centipoises bitumen. When heated to 50-80° C. the bitumen becomes slightly mobile. At this point the open hole rib could collapse. If so, flow would slow to a trickle, temperature would drop, and the rib would be plugged. However, if the conduit remains open at least long enough that the bitumen in the near vicinity is swept away with the warm steam condensate before the sand grains collapse, then it may be possible that a very high permeability, high water saturation channel might remain even with the collapse of the rib. In this case, the desired conduit would still remain effective.

Another uncertainty with many ribs along a fishbone producer of this type is that one rib may tend to develop preferentially at the expense of all the other ribs leading to very poor conformance and poor results. This would imply that some form of inflow control may be warranted to encourage more uniform development of all the ribs.

US application US20140345861 by ConocoPhillips took the fishbone concept and for the first time applied it to SAGD techniques, and showed several variations on the theme, which resulted in reduced startup time because the fishbones overlapped, or nearly so, such that the fishbone laterals contributed significantly to allowing early fluid communication. Application US20140345855 applied this idea to radial well configurations, thus minimizing wellpads.

In order to maximize bitumen recovery and reduce the amount of stranded resources, the fishbones need to be placed as low in the reservoir as possible, ideally at the same elevation of the offset producer well pair. However, our numerical simulations show that placing a fish bone so low results in cold bitumen filling and plugging the fishbone, preventing steam propagation in the fishbone and results in reduced performance relative to a conventional SAGD process.

Therefore, although beneficial, the multilateral well concept could be further developed to address some of these disadvantages or uncertainties. In particular, a method that combines multilateral well architecture with steam assisted processes would be beneficial, especially if such methods conserved the water, energy, and/or cost to produce a barrel of oil.

SUMMARY OF THE DISCLOSURE

The fishbone well concept for steam recovery methods was described in US20140345861 and US20140345855 and these methods are modified by supplementing the steam preheat with an additional heat source at the laterals in order to ensure adequate flow therein.

Typically, horizontal SAGD cased wellpairs (one injector and one producer) are placed at the base of the formation. Another cased producer is placed at a distance (normally about 50-100 meters away) parallel to the wellpair and is known as an "infill" well or "standalone producer" and serves to collect oil in the lost wedge between wellpairs.

Several uncased openhole wells "fish bones" that connect or nearly connect the wellpair and the standalone producer are drilled along the length of the wellpair. This well arrangement is designed to accelerate bitumen production and reduce the number of cased wells therefore reducing well costs and increasing the profitability of operations.

Injectors may be at the same depth or higher than the producers. Laterals nearly overlap, but typically are not connected to an adjacent well, but reach at least to the steam chamber. Laterals preferably originate at the producer (either the paired producer or standalone or both), but could be on the injectors or both injectors and producers.

Any steam injected into a well with laterals will also travel down the lateral. No effort needs be made to stop that flow. However, the standalone producer may be equipped with ICDs, ICVs or other steam control methods, to prevent steam flashing through to the standalone producer.

In order to maximize bitumen recovery and reduce the amount of stranded resources, the fishbone's need to be placed as low in the payzone reservoir as possible, ideally at the same elevation of the offset producer well pair. Our numerical simulations show that placing a fish bone so low results in cold bitumen filling and plugging the fishbone, preventing steam propagation along the fishbone and resulting in reduced performance relative to a conventional SAGD process. However, our simulations also indicate that if the fishbone is preheated with an additional heat source at the same time as the wellpair during steam circulation period (normally 3-6 months before initiating SAGD, but can be less in fishbone operations), the plugging does not occur and the fishbone performs much better. Thus, some heat in addition to the typical steam preheat during startup is beneficial.

To preheat the fishbone, several techniques are proposed herein:

MicroWave/Radio-Frequency (MW/RF) heating: Place particles susceptable to MW/RF heating inside the fishbone during or right after drilling, apply MW/RF radiation to the particles and heat them while the main SAGD wellpair is in the circulation period.

Of course, the well will need to be fitted with antenna so that the RF or MW waves could be applied thereto and the extra equipment and facilities may make this less economic than other methods. There are many patents describing how to apply electromagnetic energy to wellbores, downhole antennae, and susceptors, including U.S. Pat. Nos. 8,729,440, 8,936,090, 8,960,286, US20120305239, US20140266951, US20140266951, U.S. Pat. Nos. 8,674,274, 8,133,384, US20120085533, U.S. Pat. Nos. 8,128,786, 8,783,347, 5,082,054, 8,337,769, 8,646,527, US20140131044, U.S. Pat. No. 8,772,683, and the like.

Resistive Heating: Place conductive material with high resistivity inside the fishbone during or right after drilling, apply voltage across the fishbone and heat the material while the main wellpair is in the circulation period.

As above, there are several patents directed to resistive heating in wellbores, including U.S. Pat. Nos. 5,621,844, 6,353,706, 7,165,607, 6,942,032, and the like.

Inductive Heating: Another electrical method of heating wellbores is inductive heat. U.S. Pat. Nos. 6,285,014 and 6,353,706 describes such a tool. However, such methods may only be applicable to cased laterals.

Chemical Heating: In this context, chemical pellets are introduced into the fishbone during or right after drilling. During the steam circulation preheating period, the pellets undergo chemical reaction, generating heat in the open hole fishbone. One example is to use coated elemental sodium pellets.

There are patents describe chemical heating downhole, including e.g., US20060081374, U.S. Pat. No. 8,691,731, US20150000912, WO2013130361, and the like.

The methods described herein add additional heat, beyond what may be quickly achieved with the typical steam startup procedure, thus ensuring that the laterals are warmed, and fully available to allow flow therethrough on the commencement of production. This is particularly beneficial where startup period is reduced because it is easier to achieve fluid communication with the use of nearly overlapping laterals, and the reduced startup period is thus insufficient to heat the length of the lateral, especially when low in the pay.

The disclosure relates to well configurations that are used to improve steam recovery of oil, especially heavy oils. In general, fishbone wells replace conventional wellbores in SAGD operations. Either or both injector and producer wells are multilateral, and preferably the arrangement of lateral wells, herein called "ribs" is such as to provide overlapping coverage of the pay zone between the injector and producer wells. However, in the methods herein described, the laterals are preheated thus mitigating any risk of plugging the laterals with cold bitumen.

Where both well types have laterals, a pair of ribs can cover or nearly cover the distance between two wells, but where only one of the well types is outfitted with laterals, the lateral length can be doubled such that the single rib covers most of the distance between adjacent wells. It is also possible for laterals to intersect with each other or with one of the main wellbores, but this is not necessary.

The density and lengths of open-hole ribs may be varied to suit the particular environment, but, as noted, preferably they nearly reach, reach and/or extend beyond an opposing rib originating from an adjacent wellbore or reach or nearly reach an adjacent wellbore.

Also the spacing between injectors and producers, both vertically and laterally, in the pay section may be optimized for the particular reservoir conditions. The open-hole ribs may be horizontal, slanted, or curved in the vertical dimension to optimize performance. Where pay is thin, horizontal laterals may suffice, but if the pay is thick and/or there are many stacked thin pay zones, it may be beneficial to combine horizontal and slanted laterals, thus contacting more of the pay zone.

With sufficient lateral well coverage, it may be possible to significantly reduce conventional steam circulation for startup that is required for conventional SAGD, especially where lateral well coverage reaches from the production wells to the injector wells, thus establishing immediate or nearly immediate fluid communication. However, the lateral preheat is still beneficial for optimal performance of the laterals.

Flow distribution control may be used in either or both the injectors and producers to further optimize performance along all the ribs instead of the ones closer to the heel, and to potentially lower the development cost. In a preferred embodiment, the standalone producer is equipped with ICDs.

Such wells can be placed as infill wells or well pairs between conventional SAGD well pairs or used entirely independently of conventional SAGD well pairs.

With the fishbone SAGD methodology described herein, the injection wells may or may not be placed directly vertically above the producing well. In particular, a preferred embodiment may be to place the injectors and producers laterally apart by 50 to 150 meters, using the lateral wells to bridge the steam gaps. Combinations of lateral and vertical spacing may also be used.

The invention can comprise any one or more of the following embodiments, in any combination:

A method steam assisted gravity drainage (SAGD) production of hydrocarbons, comprising:

providing a plurality of horizontal production wells at a first depth at or near a bottom of a hydrocarbon play;

providing a plurality of horizontal injection wells, each injection well laterally spaced at a distance D from an adjacent production well;

providing a plurality of lateral wells originating from at least some of said horizontal production wells or horizontal injection wells or both, wherein said plurality of lateral wells cover at least 90% of said distance D;

preheating a reservoir by injecting steam into all wells to establish fluid communication between said injection wells and said production wells;

preheating said plurality of lateral wells using electromagnetic heating, resistive heating, or chemical heating;

continuing steam injection in said injection wells only, and simultaneously producing mobilized heavy oil from said production wells.

A method for steam production of hydrocarbons, comprising:

providing a plurality of wellpairs in a heavy oil reservoir, each wellpair including a horizontal production well at a bottom of a heavy oil payzone and a horizontal injection wells above said horizontal production well;

providing a standalone horizontal production well flanking each wellpair, said standalone horizontal production well being at or near said bottom or said heavy oil payzone and at a lateral distance D from a nearest wellpair;

providing a plurality of lateral wells originating from one or both of adjacent horizontal production wells such that said lateral wells extend over at least 90% of said first distance D between adjacent wells;

preheating said wellpair by injecting steam into all wells until fluid communication is established between said wellpair and preheating said lateral wells using electromagnetic (EM) heating, resistive heating or chemical heating;

continuing steam injection only in said injection wells after said preheating step, and simultaneously producing mobilized heavy oil from said production wells.

An improved method of fishbone SAGD comprising a plurality of horizontal production wells, and a plurality of horizontal injection wells, said production wells having a plurality of lateral wells, wherein steam is injected into all wells during a startup period until fluid communication is established, then steam is injected only into injection wells during a production period and mobilized oil is produced from said production wells, the improvement comprising preheating said lateral wells with resistive heating, EM heating or chemical heating before commencing said production period.

A method as herein described, wherein each injection well is part of a wellpair, being directly over a horizontal producer well.

A method as herein described, wherein each injection well is laterally spaced apart from a nearest producer well.

A method as herein described, wherein said plurality of lateral wells originate from every horizontal production well or every other production well and cover at least 95% or 98% or 100% of said distance D.

A method as herein described, wherein said plurality of lateral wells are arranged in an alternating pattern.

A method as herein described, wherein each injection well is about at said first depth.

A method as herein described, wherein each injection well is at a lesser depth (higher) than said first depth, or wherein each injection well is 4-10 meters higher than said first depth.

A method as herein described, wherein said distance D is at least 50 meters, 100, 150 or more.

A method as herein described, wherein said lateral wells extend over at least 95% or 98% or 100% of said first distance D between adjacent wells.

A method as herein described, wherein a standalone horizontal production well or a producer in a well pair, or both, are completed with passive inflow control devices. If desired, the injectors can also include passive ICDs.

A method as herein described, wherein said EM heating uses a downhole antenna to heat susceptors in said lateral well, and an EM wavelength activates and heats said susceptors or wherein said EM heating uses a downhole antenna and an RF wavelength to heat susceptors in said lateral well.

A method as herein described, wherein said resistive heating uses electric current and a conductive material in said lateral well, said electric current travelling through and heating said conductive material.

A method as herein described, wherein said chemical heating uses a chemical pellet that exothermically reacts with water and wherein condensed steam is used to activate said chemical pellet.

"Vertical" drilling is the traditional type of drilling in oil and gas drilling industry, and includes well <45° of vertical.

"Horizontal" drilling is the same as vertical drilling until the "kickoff point" which is located just above the target oil or gas reservoir (pay zone), from that point deviating the drilling direction from the vertical to horizontal. By "horizontal" what is included is an angle within 45° (≤45°) of horizontal.

"Multilateral" wells are wells having multiple branches (laterals) tied back to a mother wellbore (also called the "originating" well), which conveys fluids to or from the surface. The branch or lateral may be vertical or horizontal, or anything therebetween.

A "lateral" well as used herein refers to a well that branches off an originating well. An originating well may have several such lateral wells (together referred to as multilateral wells), and the lateral wells themselves may also have lateral wells. The laterals may also be called ribs or fishbones herein.

An "openhole well" as used herein means the well is not cased.

An "alternate pattern" or "alternating pattern" as used herein means that subsequent lateral wells alternate in direction from the originating well, first projecting to one side, then to the other.

As used herein a "slanted" well with respect to lateral wells, means that the well is not in the same plane as the kickoff point from the originating well, but travels upwards or downwards from same.

As used herein, "overlapping" multilateral wells, means the ends of lateral wells from adjacent wellbores nearly reach or even pass each other or the next adjacent main wellbore, when viewed from the top.

Overlapping lateral wells is one option, but it may be more cost effective to provide e.g., only producers with lateral wells. In such cases, the laterals can be made longer so as to reach or nearly reach or even intersect with an adjacent well. In this way, fewer laterals are needed, but the reservoir between adjacent main wellbores is still adequately covered to enable efficient steam communication and good drainage.

By "nearly reach" we mean at least 90% of the distance between adjacent main wellbores is covered by a lateral or a pair of laterals.

By "main wellbores" what is meant are injector and producer wells. Producer wells can also be used for injection early in the process.

By "wellpair" what is meant is the traditional SAGD well pair with a horizontal injector over a horizontal producer.

By "standalone producer" what is meant is a production well, low in the pay that does not have an injector above it.

By "startup" what is meant is a period before production when all wells are fitted for injection. This is typically used in SAGD to establish fluid communication between wellpairs. Startup is typically 3-6 months, but may be significantly reduced with the use of fishbone wells.

By "preheating laterals" what is meant is that additional heat (beyond the usual steam startup heat) is supplied to the laterals, to ensure good flow of hydrocarbons therethrough.

By "SAGD" in the claims, we include any of the variations on SAGD so long as steam and gravity are used to some extent. Thus, solvent assisted SA-SAGD, gas-push SAGD, single well-SAGD, and the like are all included. Although we focus herein on steam-based processes, the invention can also be applied to other processes, such as combustion-based processes, solvent based processes, and the like.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| | |
|---|---|
| SAGD | Steam assisted gravity drainage |
| EM | Electromagnetic |

-continued

| | |
|---|---|
| RF | Radio frequency |
| MW | Microwave |
| FCD | Flow control device |
| ICD | Inflow control device |
| ICV | Interval control valve, an active flow control device |

BRIEF DESCRIPTION OF THE DRAWINGS

FIG. 4C is a horizontal plane view (top view) of both FIGS. 4A and B.

DETAILED DESCRIPTION

Figure 1:
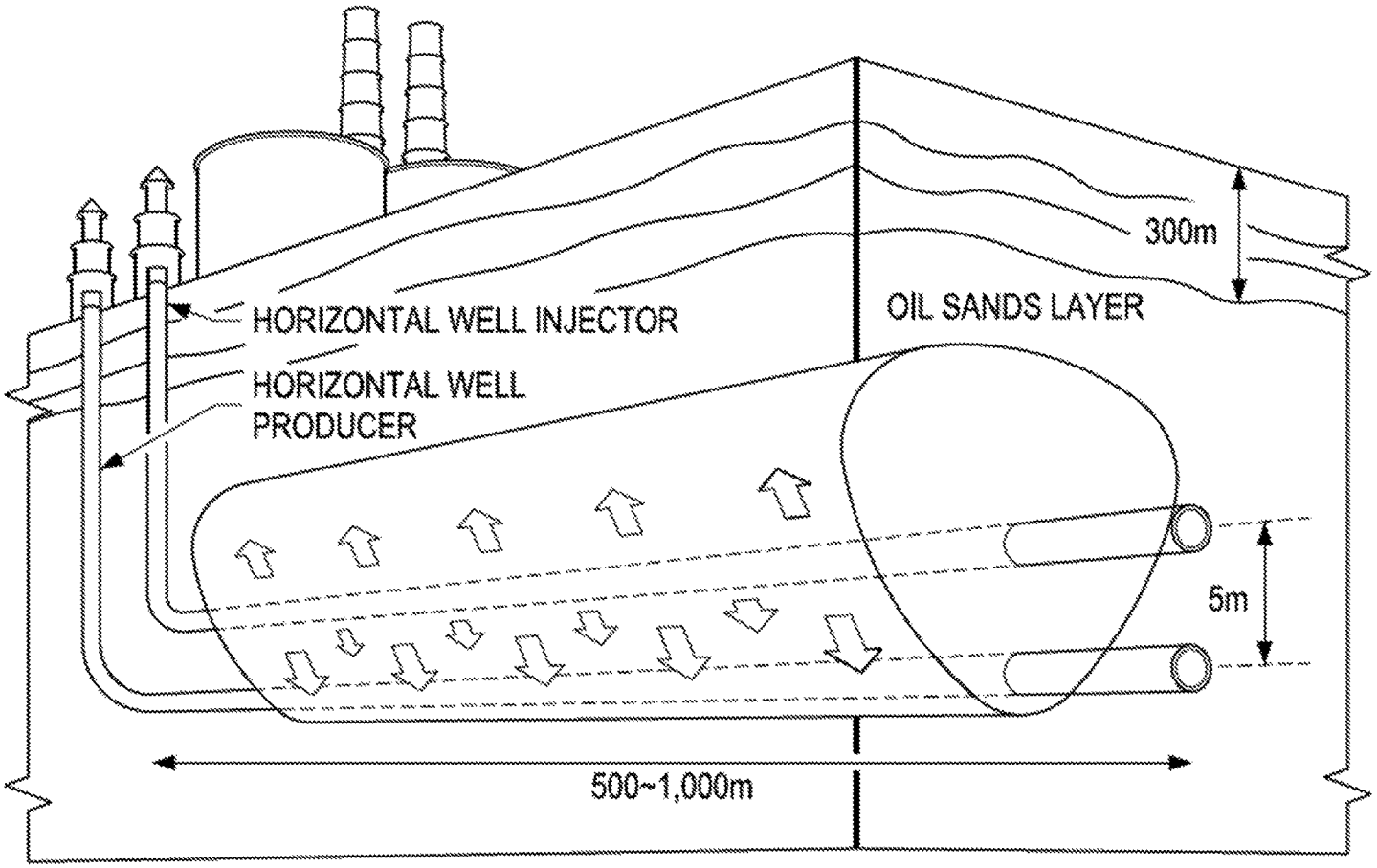
FIG. 1 (PRIOR ART)
FIG. 1 shows a conventional SAGD well pair.
Figure 2:
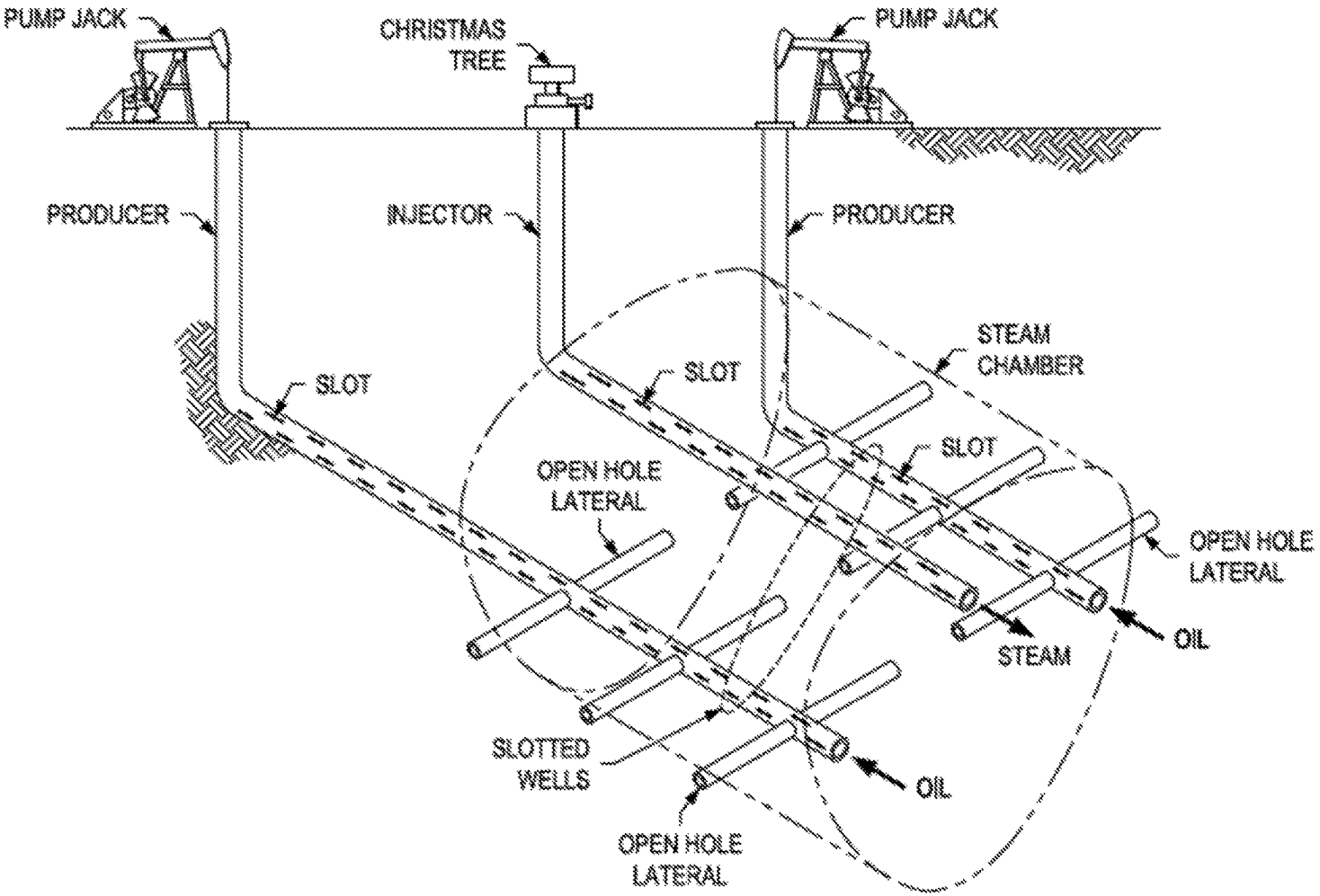
FIG. 2 is a view of two producer wells having lateral openhole wells thereon (fishbones), with a higher injector well therebetween.
Figure 3:
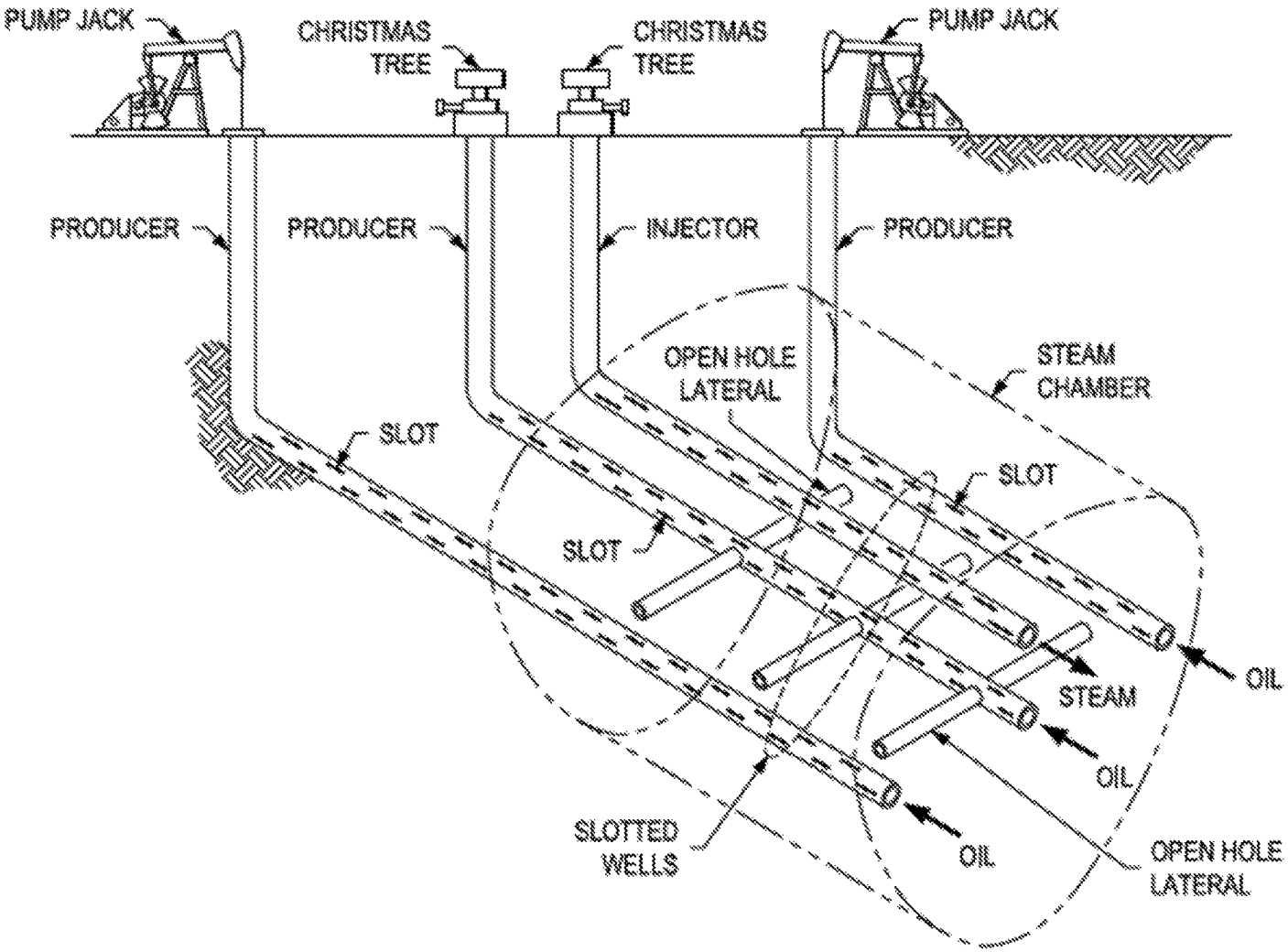
FIG. 3 shows a SAGD wellpair bracketed by a pair of standalone producer wells.
Figure 4A:
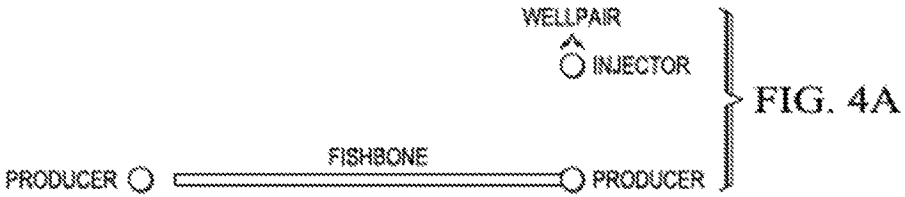
FIG. 4A-C shows variation in placement of lateral well depth, being at the same depth as the producer of the wellpair in A and somewhat higher in B.
Figure 4B:
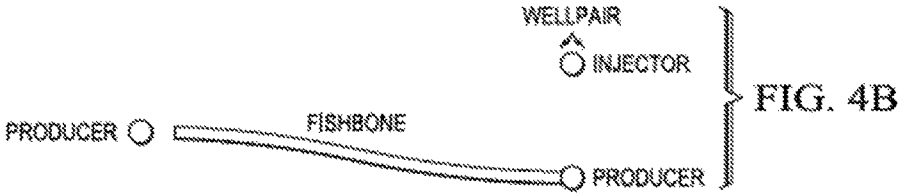
Figure 4C:
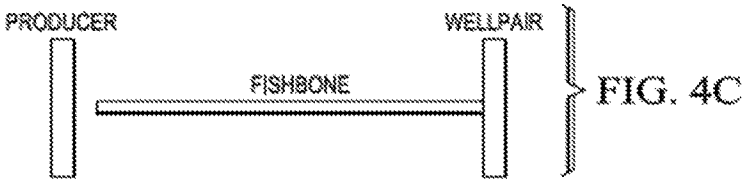

The following is a detailed description of the preferred method of the present invention. It should be understood that the inventive features and concepts may be manifested in other arrangements and that the scope of the invention is not limited to the embodiments described or illustrated. The scope of the invention is intended to only be limited by the scope of the claims that follow.

The present invention provides a novel fishbone SAGD method, which uses the "fishbone" SAGD configurations previously described, wherein injectors or producers or both are both fitted with a plurality of multilateral wells, and wherein the fishbones are preheated to mitigate plugging. Once the laterals are preheated and fluid communication is established, the enhanced oil recovery method precedes as normal.

Although particularly beneficial in gravity drainage techniques, this is not essential and the configuration and methods could be used for horizontal sweeps as well. The well configuration can be used in any enhanced oil recovery techniques, including cyclic steam stimulations, SAGD, expanding solvent SAGD, polymer sweeps, water sweeps, and the like.

The ribs can be placed in any arrangement known in the art, depending on reservoir characteristics and the positioning of nonporous rocks and the play. Ribs can originate from producers or injectors or both, but preferably originate from the producers. Ribs can be placed on each producer, but preferably are used every other producer. E.g., every producer in a wellpair or very standalone producer.

The ribs can be planar or slanted or both, e.g., preferably slanting upwards towards the injectors, where injectors are placed higher in the pay. However, injectors need not be higher in the pay with this method. Nonetheless, upwardly slanted wells may be desirable to contact more of a thick pay, or where thin stacked pay zones exist. Downwardly slanting wells may also be used in some cases. Combinations of planar and slanted wells are also possible.

The rib arrangement on a particular main well can be pinnate, alternate, radial, or combinations thereof. The ribs can also have further ribs, if desired.

The fishbones are preheated by one the following methods:

EM Heating

Electromagnetic heating using microwaves (MW) or Radio-Frequency (RF) waves can be used, particularly where susceptors are placed inside the fishbone during or right after drilling. One applies MW/RF radiation to the susceptors, thus preheating them before commencing production, e.g., during the preheat period to establish fluid communication. If there is sufficient connate water in the laterals, the susceptor may be omitted, and water heating frequencies used instead.

By "susceptor" herein, what is meant is any material that absorbs the microwave or radio frequency(s) applied to the reservoir. Any susceptors can be used in the method. U.S. Pat. No. 8,133,384, for example, described carbon fiber susceptors that can be heated e.g., using 2450 MHz (microwave). Other examples of susceptor materials are disclosed in U.S. Pat. Nos. 5,378,879; 6,649,888; 6,045,648; 6,348,679; and 4,892,782.

It is known in the art how to arrange antennae for effective heating using electromagnetic heating. See e.g., US20120085533 (CCS using RF); U.S. Pat. No. 8,616,273 (RF preheating and solvent extraction); US20120061080 (reheating steam); U.S. Pat. No. 8,807,220 (in situ upgrading using RF); U.S. Pat. No. 8,729,440 (RF heater); US20140110395 (RF heater).

In one exemplary embodiment, RF energy can be applied in a manner that causes the susceptor particles to heat by induction. Induction heating involves applying an RF field to electrically conducting materials to create electromagnetic induction. An eddy current is created when an electrically conducting material is exposed to a changing magnetic field due to relative motion of the field source and conductor; or due to variations of the field with time. This can cause a circulating flow or current of electrons within the conductor. These circulating eddies of current create electromagnets with magnetic fields that opposes the change of the magnetic field according to Lenz's law. These eddy currents generate heat. The degree of heat generated in turn, depends on the strength of the RF field, the electrical conductivity of the heated material, and the change rate of the RF field. There can be also a relationship between the frequency of the RF field and the depth to which it penetrates the material; in general, higher RF frequencies generate a higher heat rate.

Induction RF heating can be for example carried out using conductive susceptor particles. Exemplary susceptors for induction RF heating include powdered metal, powdered iron (pentacarbonyl E iron), iron oxide, or powdered graphite. The RF source used for induction RF heating can be for example a loop antenna or magnetic near-field applicator suitable for generation of a magnetic field.

The RF source typically comprises an electromagnet through which a high-frequency alternating current (AC) is passed. For example, the RF source can comprise an induction heating coil, a chamber or container containing a loop antenna, or a magnetic near-field applicator. The exemplary RF frequency for induction RF heating can be from about 50 Hz to about 3 GHz. Alternatively, the RF frequency can be from about 10 kHz to about 10 MHz, 10 MHz to about 100 MHZ, or 100 MHz to about 2.5 GHz. The power of the RF energy, as radiated from the RF source, can be for example from about 100 KW to about 2.5 MW, alternatively from about 500 KW to about 1 MW, and alternatively, about 1 MW to about 2.5 MW. Of course, the frequency is tailored to activate the particular susceptor or blend of susceptors used.

In another exemplary embodiment, RF energy can be applied in a manner that causes the susceptor particles to heat by magnetic moment heating, also known as hysteresis heating. Magnetic moment heating is a form of induction RF heating, whereby heat is generated by a magnetic material. Applying a magnetic field to a magnetic material induces electron spin realignment, which results in heat generation. Magnetic materials are easier to induction heat than non-magnetic materials, because magnetic materials resist the rapidly changing magnetic fields of the RF source. The electron spin realignment of the magnetic material produces hysteresis heating in addition to eddy current heating. A metal which offers high resistance has high magnetic permeability from 100 to 500; non-magnetic materials have a permeability of 1. One advantage of magnetic moment heating can be that it can be self-regulating. Magnetic moment heating only occurs at temperatures below the Curie point of the magnetic material, the temperature at which the magnetic material loses its magnetic properties.

Magnetic moment RF heating can be performed using magnetic susceptor particles. Exemplary susceptors for magnetic moment RF heating include ferromagnetic materials or ferrimagnetic materials. Exemplary ferromagnetic materials include iron, nickel, cobalt, iron alloys, nickel alloys, cobalt alloys, and steel. Exemplary ferrimagnetic materials include magnetite, nickel-zinc ferrite, manganese-zinc ferrite, and copper-zinc ferrite. In certain embodiments, the RF source used for magnetic moment RF heating can be the same as that used for induction heating—a loop antenna or magnetic near-field applicator suitable for generation of a magnetic field, such as an induction heating coil, a chamber or container containing a loop antenna, or a magnetic near-field applicator.

The exemplary RF frequency for magnetic moment RF heating can be from about 100 kHz to about 3 GHz. Alternatively, the RF frequency can be from about 10 kHz to about 10 MHz, 10 MHz to about 100 MHZ, or 100 MHz to about 2.5 GHz. The power of the RF energy, as radiated from the RF source, can be for example from about 100 KW to about 2.5 MW, alternatively from about 500 KW to about 1 MW, and alternatively, about 1 MW to about 2.5 MW.

In a further exemplary embodiment, the RF energy source and susceptor particles selected can result in dielectric heating. Dielectric heating involves the heating of electrically insulating materials by dielectric loss. Voltage across a dielectric material causes energy to be dissipated as the molecules attempt to line up with the continuously changing electric field.

Dielectric RF heating can be for example performed using polar, non-conductive susceptor particles. Exemplary susceptors for dielectric heating include butyl rubber (such as ground tires), barium titanate, aluminum oxide, or PVC. Water can also be used as a dielectric RF susceptor. Dielectric RF heating typically utilizes higher RF frequencies than those used for induction RF heating. At frequencies above 100 MHz an electromagnetic wave can be launched from a small dimension emitter and conveyed through space. The material to be heated can therefore be placed in the path of the waves, without a need for electrical contacts. For example, domestic microwave ovens principally operate through dielectric heating, whereby the RF frequency applied is about 2.45 GHz. The RF source used for dielectric RF heating can be for example a dipole antenna or electric near field applicator.

An exemplary RF frequency for dielectric RF heating can be from about 100 MHz to about 3 GHz. Alternatively, the RF frequency can be from about 500 MHz to about 3 GHz. Alternatively, the RF frequency can be from about 2 GHz to about 3 GHz. The power of the RF energy, as radiated from the RF source, can be for example from about 100 KW to about 2.5 MW, alternatively from about 500 KW to about 1 MW, and alternatively, about 1 MW to about 2.5 MW.

Resistive Heating

For resistive heating, a conductive material with high resistivity is placed inside the fishbone during or right after drilling. Voltage is then applied across the fishbone, thus heating the material while the main wellpair is in the preheat stage.

In situ processes involving downhole heaters are described in a large number of publications, including U.S. Pat. Nos. 2,634,961; 2,732,195; 2,780,450; 2,548,360; 4,716,960; 5,060,287; 6,023,554; 6,360,819; and SPE-165323-MS. Indeed, SPE-165323-MS (2013) Hale, et al., History and Application of Resistance Electrical Heating in Downhole Oil Field Applications provides a discussion of resistive heat use downhole, and notes that engineers are now modeling reservoir stimulation for pilots in Alberta with heaters as long as 2300 meters, operating at 4160 Volts with output of up to 1000 watts per meter.

Preferred lateral heating methods include introducing conductive high resistivity material (i.e. metal proppants, materials in powder or granular form) to the fishbone, and applied voltage using the conductive materials as an electrical conduit inducing heating of the fishbone lateral. E.g., U.S. Pat. Nos. 8,087,460, 8,168,570, 3,642,066.

In one aspect, the material comprising the conductive granular material has an electrical resistivity of less than 0.0001 Ohm-meters. More preferably, the material comprising the granular material has an electrical resistivity of less than 0.000001 Ohm-meters. The electrically conductive granular material may include metal, metal coated particles, coke or graphite. In one embodiment, the granular material is comprised of a mixture of granular materials of differing electrical conductivity.

Chemical Heating

The fishbone can also be heating chemically, by introducing one or more compounds that react to produce heat in an exothermic reaction. In this context, chemical pellets are introduced into the fishbone during or right after drilling. During the steam circulation preheating period, the pellets undergo chemical transformation, releasing heat in the open hole fishbone thus achieving the preheating effect.

One example is to use coated elemental sodium pellets. The highly exothermic reaction of sodium with the in-situ formation water results in the liberation of large amount of heat which reduces oil viscosity and can potentially generate in-situ steam as well. The coating prevents instantaneous reaction of sodium with water right after placement of pellets in the fishbone. Instead, the coating will degrade over time, and the exothermic reaction with connate water or steam that has traveled through the fishbones will provide heat in the fishbones over a required period of time. Another important advantage of this process is the formation of sodium hydroxide, which reduces the interfacial tension at the bitumen interface and improves the recovery.

An alternative process can be carried out by displacement of carbon dioxide in a simultaneous injection of carbon dioxide and elemental sodium in a heavy oil reservoir. When sodium suspended in liquid carbon dioxide is injected into the reservoir, it will diffuse through the carrier phase and then interact with water, releasing heat resulting in oil viscosity reduction and enhanced mobility due to the combined benefit from carbon dioxide solubility and the exothermic reaction heat.

Other exothermic reactions are known. US20140090839, for example, describes injecting an aqueous composition comprising an ammonium containing compound and a nitrite containing compound into the reservoir; and then injecting an activator. The activator initiates a reaction between the ammonium containing compound and the nitrite containing compound, such that the reaction generates steam and nitrogen gas, increasing localized pressure and improving oil mobility.

Other examples include use of alkali metals such as potassium, lithium, and combustion with magnesium, metal alloys, calcium, iron, phosphorus, sulfur, solid propellants, etc. Combustion of magnesium, calcium, iron, phosphorus, sulfur, and metal alloys will require injection of oxidizer such as air/oxygen. On the other hand, solid propellants contain both fuel and oxidizer and do not require any additional oxidizing agent.

The following references are incorporated by reference in their entireties for all purposes.

CA2684049 Infill well methods for SAGD well heavy hydrocarbon recovery operations EME 580 Final Report: Husain, et al., Economic Comparison of Multi-Lateral Drilling over Horizontal Drilling for Marcellus Shale Field (2011), available online at ems.psu.edu/~elsworth/courses/egee580/2011/Final%20Reports/fishbone_report.pdf Hogg, C. 1997. Comparison of Multilateral Completion Scenarios and Their Application. Presented at the Offshore Europe, Aberdeen, United Kingdom, 9-12 September. SPE-38493-MS.

OTC 16244, Lougheide, et al. Trinidad's First Multilateral Well Successfully Integrates Horizontal Openhole Gravel Packs, OTC (2004).

petrowiki.org/Multilateral_completions

SPE 69700-MS, "Multilateral-Horizontal Wells Increase Rate and Lower Cost Per Barrel in the Zuata Field, Faja, Venezuela", Mar. 12, 2001.

SPE-165323-MS (2013) Hale, et al., History and Application of Resistance Electrical Heating in Downhole Oil Field Applications STALDER J. L., et al., Alternative Well Configurations in SAGD: Rearranging Wells to Improve Performance, presented at 2012 World Heavy Oil Congress [WHOC12], available online at osli.ca/uploads/files/Resources/Alternative%20Well%20Configurations%20in%20SAGD_WHO C2012.pdf Technical Advancements of Multilaterals (TAML). 2008. Available at taml-intl.org/taml-background/

US20060081374 Process for downhole heating

US20110067858 Fishbone well configuration for in situ combustion

US20120061080 Process for downhole heating

US20120085533 Cyclic steam stimulation using RF

US20120227966 In situ catalytic upgrading

US20120247760 Dual injection points in SAGD

US20120305239 Cyclic radio frequency stimulation

US20130008651 Method for hydrocarbon recovery using SAGD and infill wells with RF heating US20140090839 Enhanced oil recovery by in-situ steam generation US20140110395 System including tunable choke for hydrocarbon resource heating and associated methods US20140131044 Hydrocarbon resource heating device including superconductive material RF antenna and related methods US20140266951 Subsurface antenna for radio frequency heating US20140345855 Radial Fishbone SAGD US20140345861 Fishbone SAGD US20150000912 In-situ downhole heating for a treatment in a well U.S. Pat. No. 2,548,360 Electric oil well heater U.S. Pat. No. 2,634,961 Method of electrothermal production of shale oil U.S. Pat. No. 2,732,195 Method of treating oil shale and recovery of oil and other mineral products therefrom U.S. Pat. No. 2,780,450 Method of recovering oil and gases from non-consolidated bituminous geological formations by a heating treatment in situ U.S. Pat. No. 3,642,066 Electrical method and apparatus for the recovery of oil U.S. Pat. No. 4,716,960 Method and system for introducing electric current into a well U.S. Pat. No. 4,892,782 Fibrous microwave susceptor packaging material U.S. Pat. No. 5,060,287 Heater utilizing copper-nickel alloy core U.S. Pat. No. 5,082,054 In-situ tuned microwave oil extraction process U.S. Pat. No. 5,378,879 Induction heating of loaded materials U.S. Pat. No. 5,621,844 Electrical heating of mineral well deposits using downhole impedance transformation networks U.S. Pat. No. 6,023,554 Electrical heater U.S. Pat. No. 6,045,648 Thermoset adhesive having susceptor particles therein U.S. Pat. No. 6,285,014 Downhole induction heating tool for enhanced oil recovery U.S. Pat. No. 6,348,679 RF active compositions for use in adhesion, bonding and coating U.S. Pat. No. 6,353,706 Optimum oil-well casing heating U.S. Pat. No. 6,360,819 Electrical heater U.S. Pat. No. 6,649,888 Radio frequency (RF) heating system U.S. Pat. Nos. 6,942,032 7,165,607 Resistive down hole heating tool U.S. Pat. No. 8,087,460 Granular electrical connections for in situ formation heating U.S. Pat. No. 8,128,786 RF heating to reduce the use of supplemental water added in the recovery of unconventional oil U.S. Pat. No. 8,133,384 8,337,769 Carbon strand radio frequency heating susceptor U.S. Pat. No. 8,168,570 Method of manufacture and the use of a functional proppant for determination of subterranean fracture geometries U.S. Pat. No. 8,333,245 8,376,052 Accelerated production of gas from a subterranean zone U.S. Pat. No. 8,616,273 Effective solvent extraction system incorporating electromagnetic heating U.S. Pat. No. 8,646,527 8,783,347 Radio frequency enhanced steam assisted gravity drainage method for recovery of hydrocarbons U.S. Pat. No. 8,674,274 Apparatus and method for heating material by adjustable mode RF heating antenna array U.S. Pat. No. 8,691,731 Heat generation process for treating oilfield deposits U.S. Pat. No. 8,729,440 Applicator and method for RF heating of material U.S. Pat. No. 8,772,683 Apparatus and method for heating of hydrocarbon deposits by RF driven coaxial sleeve U.S. Pat. No. 8,807,220 Simultaneous conversion and recovery of bitumen using RF U.S. Pat. No. 8,936,090 Inline RF heating for SAGD operations U.S. Pat. No. 8,960,286 Heavy oil recovery using SF6 and RF heating US20130220616 In situ heat generation

What is claimed is:

1. A method for steam assisted gravity drainage (SAGD) production of hydrocarbons, comprising:

a) providing a plurality of horizontal production wells at a first depth at or near a bottom of a hydrocarbon play;

b) providing a plurality of horizontal injection wells, each injection well laterally spaced at a distance D from an adjacent production well, wherein said distance D is at least 50 meters:

c) providing a plurality of lateral wells originating from at least some of said horizontal production wells or horizontal injection wells or both, wherein said plurality of lateral wells cover at least 90% of said distance D and are open-hole laterals:

d) preheating a reservoir by injecting steam into all wells to establish fluid communication between said injection wells and said production wells;

e) preheating said plurality of lateral wells using electromagnetic heating, resistive heating, or chemical heating; and f) continuing steam injection in said injection wells only, and simultaneously producing mobilized heavy oil from said production wells.

2. The method of claim 1, wherein said plurality of lateral wells originate from every horizontal production well or every other production well and cover at least 95% of said distance D.

3. The method of claim 1, wherein said plurality of lateral wells are arranged in an alternating pattern.

4. The method of claim 1, wherein each injection well is about at said first depth.

5. The method of claim 1, wherein each injection well is at a lesser depth than said first depth.

6. The method of claim 1, wherein said distance D is at least 150 meters.

7. The method of claim 1, wherein said distance D is at least 100 meters.

8. A method for production of hydrocarbons, comprising:

a) providing a plurality of wellpairs in a heavy oil reservoir, each wellpair including a horizontal production well at a bottom of a heavy oil payzone and a horizontal injection well above said horizontal production well;

b) providing a standalone horizontal production well flanking each wellpair, said standalone horizontal production well being at or near said bottom or said heavy oil payzone and at a lateral distance D from a nearest wellpair, wherein said distance D is at least 50 meters;

c) providing a plurality of lateral wells originating from one or both of adjacent horizontal production wells such that said lateral wells extend over at least 90% of said distance D and are open hole lateral wells;

d) preheating said wellpair by injecting steam into all wells until fluid communication is established between said wellpair and simultaneously preheating said lateral wells using electromagnetic (EM) heating, resistive heating or chemical heating; and e) continuing steam injection only in said injection wells after said preheating step d, and simultaneously producing mobilized heavy oil from said production wells.

9. The method of claim 8, wherein said distance D is at least 100 meters.

10. The method of claim 8, wherein said distance D is at least 150 meters.

11. The method of claim 8, wherein said lateral wells extend over at least 95% of said distance D between adjacent wells.

12. The method of claim 8, wherein said standalone horizontal production well is completed with passive inflow control devices.

13. The method of claim 8, wherein said EM heating uses a downhole antenna to heat susceptors in said lateral well, and an EM wavelength activates and heats said susceptors.

14. The method of claim 8, wherein said EM heating uses a downhole antenna and an RF wavelength to heat susceptors in said lateral well.

15. The method of claim 8, wherein said resistive heating uses electric current and a conductive material in said lateral well, said electric current travelling through and heating said conductive material.

16. The method of claim 8, wherein said chemical heating uses a chemical pellet that exothermically reacts with water and wherein condensed steam is used to activate said chemical pellet.

* * * * *